US007061351B2

(12) United States Patent
Suzuki et al.

(10) Patent No.: US 7,061,351 B2
(45) Date of Patent: Jun. 13, 2006

(54) COMPLEX RELAY DEVICE

(75) Inventors: Hirohisa Suzuki, Nishio (JP); Koichi Sato, Anjo (JP)

(73) Assignee: Anden Co., Ltd., Anjo (JP)

( * ) Notice: Subject to any disclaimer, the term of this patent is extended or adjusted under 35 U.S.C. 154(b) by 0 days.

(21) Appl. No.: 11/239,061

(22) Filed: Sep. 30, 2005

(65) Prior Publication Data

US 2006/0082428 A1 Apr. 20, 2006

(30) Foreign Application Priority Data

Oct. 15, 2004 (JP) ..... 2004-302189

(51) Int. Cl.
*H01H 51/22* (2006.01)
*H01H 9/00* (2006.01)

(52) U.S. Cl. ..... 335/78; 335/159

(58) Field of Classification Search ..... 335/78–86, 335/159, 162

See application file for complete search history.

(56) References Cited

U.S. PATENT DOCUMENTS 6,337,614 B1 * 1/2002 Tsutsui ..... 335/160
6,414,576 B1 * 7/2002 Nakamura et al. ..... 335/83
6,686,821 B1 2/2004 Suzuki ..... 335/128

FOREIGN PATENT DOCUMENTS

JP A 2002-343216 11/2002

* cited by examiner

*Primary Examiner*—Ramon M. Barrera
(74) *Attorney, Agent, or Firm*—Oliff & Berridge PLC

(57) ABSTRACT

A complex relay device has at least one bus bar base plate, two relay units, and a relay case. The bus bar base plate has multiple bus bars that have ends providing terminals and are formed in predetermined circuit patterns. The bus bars are integrated and covered with a resin except for at least the ends. The two relay units are fixed on the bus bar base plate such that the two relay units are adjacent to each other and are connected to the terminals, which are used for external connection, through the bus bars. The relay case accommodates the bus bar base plate and the two relay units.

12 Claims, 7 Drawing Sheets

COMPLEX RELAY DEVICE

CROSS REFERENCE TO RELATED APPLICATION

This application is based on and incorporates herein by reference Japanese Patent Application No. 2004-302189 filed on Oct. 15, 2004.

BACKGROUND OF THE INVENTION

1. Field of the Invention

The present invention relates to a complex relay device that has multiple assembled relays.

2. Description of Related Art

JP-A-2002-343216 describes a complex relay device. This complex relay device uses a bus bar base plate, on which multiple bus bars are formed in a predetermined circuit pattern. The bus bars except for at least a relay connection terminal and an external connection terminal of the bus bars are covered with a resin. The multiple bus bars are integrated so that the external connection terminal is connected with the relay connection terminal through the bus bars. Multiple relay units are fixed and connected to the bus bar base plate. The complex relay device communizes a circuit base plate or external terminals for a plurality of relay units. Therefore, wiring work can be simplified and the multiplicity of relays can be located in a compact space.

Usually, the relay units or wiring of the complex relay device are accommodated in a resin relay case to improve waterproof property, dustproof property, and strength.

It is difficult to use the complex relay device in an environment in which a thermal condition or a vibration condition is harsh, e.g., in an engine compartment for the following reasons.

Since high rigidity is required in such a harsh environment, thickness of the relay case should be increased. As a result, the temperature inside a relay accommodation space formed in the relay case increases. Specifically, out of the multiplicity of relay units arranged in line on a side surface of the bus bar base plate, the relay unit at a central portion of the relay case suffers a more severe temperature increase than the relay units at peripheral portions of the relay case. This occurs because the relay unit at the central portion receives heat from both adjacent relay units and has a small heat radiation area facing the relay case.

As a result, electric resistance of a contact circuit in the relay unit, which is formed by a spring and the bus bar wiring between a contact of the relay unit and the external terminal, becomes larger in the relay unit at the central portion than in the relay units at peripheral portions. Accordingly, resistance loss and heat generation increase and a maximum contact current value for opening or closing the contact decreases in the relay unit at the central portion. If a multiplicity of relay units are arranged in the vibration-resistant, thick and hermetic case, the temperature of the relay unit at the central portion increases compared to that of the relay units at the peripheral portions. Accordingly, the current capable of flowing through the relay units is reduced. The increase in the resistance of the contact circuit of the relay unit at the central portion causes a further increase the generation of heat.

The temperature increase at the relay unit at the central portion greater than the temperature increase at the relay units at the peripheral portions will increase coil resistance of the relay unit at the central portion and deteriorate magnetic characteristics of the relay unit at the central portion. In order for the relay unit at the central portion to operate properly, coil current flowing through the coil of the relay unit at the central portion has to be increased compared to coil current flowing through the coils of the relay units at the peripheral portions. Therefore, voltage (coil application voltage) applied to the relay unit has to be increased compared to that of a single relay. As a result, the temperature increase in the relay case, specifically, the temperature increase at the central portion of the relay case, will enlarge.

If the complex relay device, which integrates multiple relays, is used in a high-temperature and high-vibration environment, the relay device is increased in its size and weight compared to the case where single relays are used, because reduction of the contact circuit resistance and coil resistance is necessary. Accordingly, using the necessary number of single-relay devices is more advantageous than using the complex relay device with respect to compactness.

SUMMARY OF THE INVENTION

It is therefore an object of the present invention to provide a complex relay device capable of ensuring operation reliability in a high-temperature environment while ensuring compactness and inhibiting power consumption.

According to an aspect of the present invention, a complex relay device has at least one bus bar base plate, only two relay units, and a relay case. The bus bar base plate has multiple bus bars that have ends providing terminals and are formed in predetermined circuit patterns. The bus bars are integrated and covered with a resin except for at least the ends thereof. The two relay units are fixed on the bus bar base plate such that the two relay units are adjacent to each other and are connected to the terminals, which are used for external connection, through the bus bars. The relay case accommodates the bus bar base plate and the two relay units.

The two relay units fixed to the bus bar base plate such that the two relay units are adjacent to each other are accommodated in the relay case to provide a double relay device. The double relay device has no relay unit that is sandwiched between other relay units. Therefore, temperature increase of one relay unit greater than temperature increase of another relay unit can be inhibited, while locating the two relay units to be adjacent to each other in a compact size.

As a result, increase of electric resistance of the bus bar or a spring as conductive members of a contact circuit can be inhibited without increasing sectional areas thereof. Accordingly, increase of a resistance loss at the contact circuit and decrease of contact current can be inhibited. Moreover, necessary coil current can be ensured without increasing a coil sectional area. Thus, a compact relay device that consumes a relatively small amount of electricity and provides a relatively large opening-closing current, below which the relay device can be opened and closed, can be provided.

Temperature increase conditions (or cooling conditions) of the pair of relay units are substantially the same. Therefore, deviation of contact current characteristics or coil characteristics between the relay units can be inhibited. This is advantageous compared to a triple relay device because, in the triple relay device, operation conditions of relays at peripheral portions of the triple relay device have to be coordinated with operation condition of a relay device at a central portion of the triple relay device, where the characteristics are the worst.

According to another aspect of the present invention, a complex relay device has at least one bus bar base plate, at least first and second relay units, and a relay case, wherein the relay device does not include any relay unit that is sandwiched between two relay units. The bus bar base plate has multiple bus bars that have ends providing terminals and are formed in predetermined circuit patterns. The bus bars are integrated and covered with a resin except for at least the ends thereof. The relay units are fixed on the bus bar base plate such that at least the first and second relay units are adjacent to each other and are connected to the terminals, which are used for external connection, through the bus bars. The relay case accommodates the bus bar base plate and the relay units. The relay device does not include any relay unit that is sandwiched between two relay units.

BRIEF DESCRIPTION OF THE DRAWINGS

Features and advantages of exemplary embodiments will be appreciated, as well as methods of operation and the function of the related parts, from a study of the following detailed description, the appended claims, and the drawings, all of which form a part of this application. In the drawings:

DETAILED DESCRIPTION OF EXEMPLARY EMBODIMENTS

Figure 1:
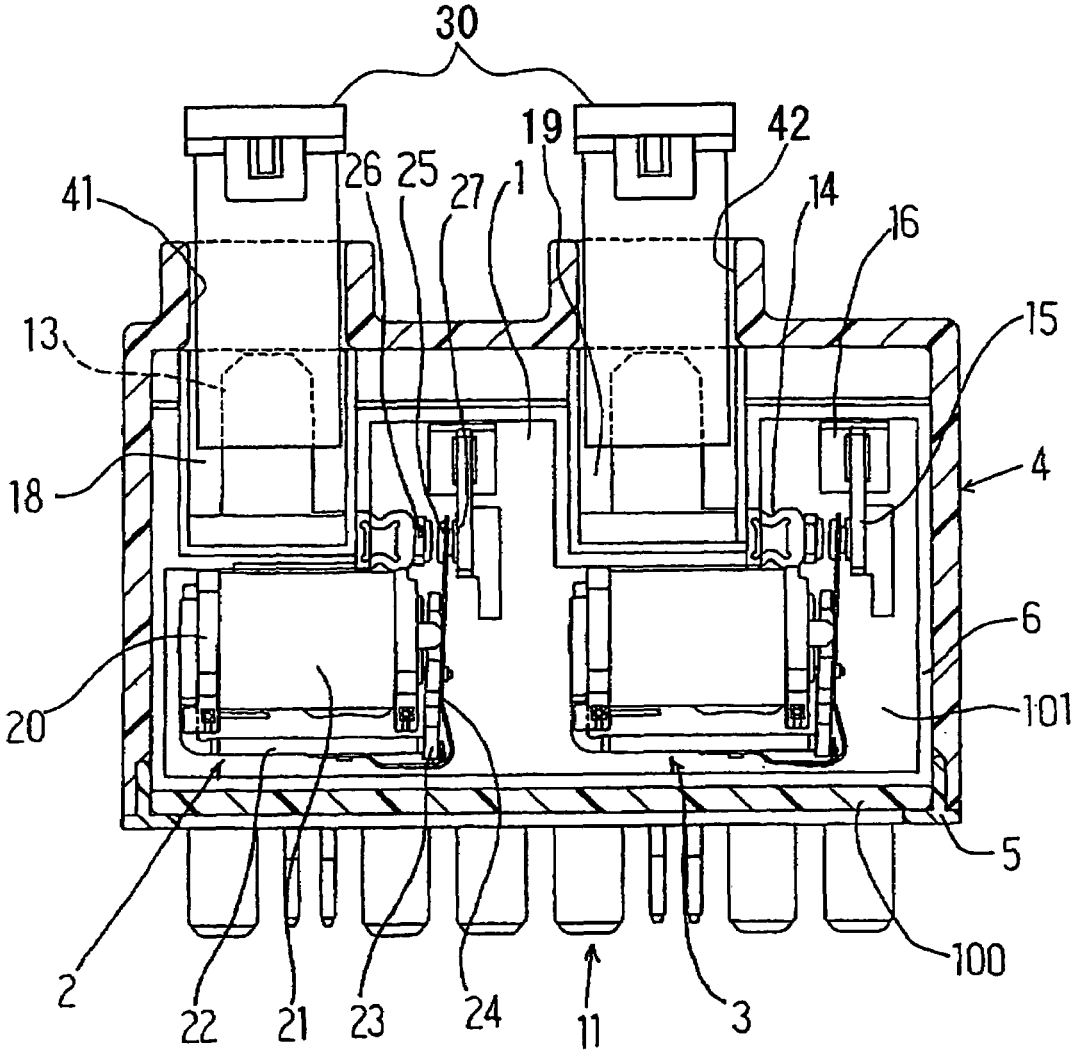
FIG. 1 is a longitudinal cross-sectional view showing a relay device according to a first exemplary embodiment of the present invention.
Figure 2:
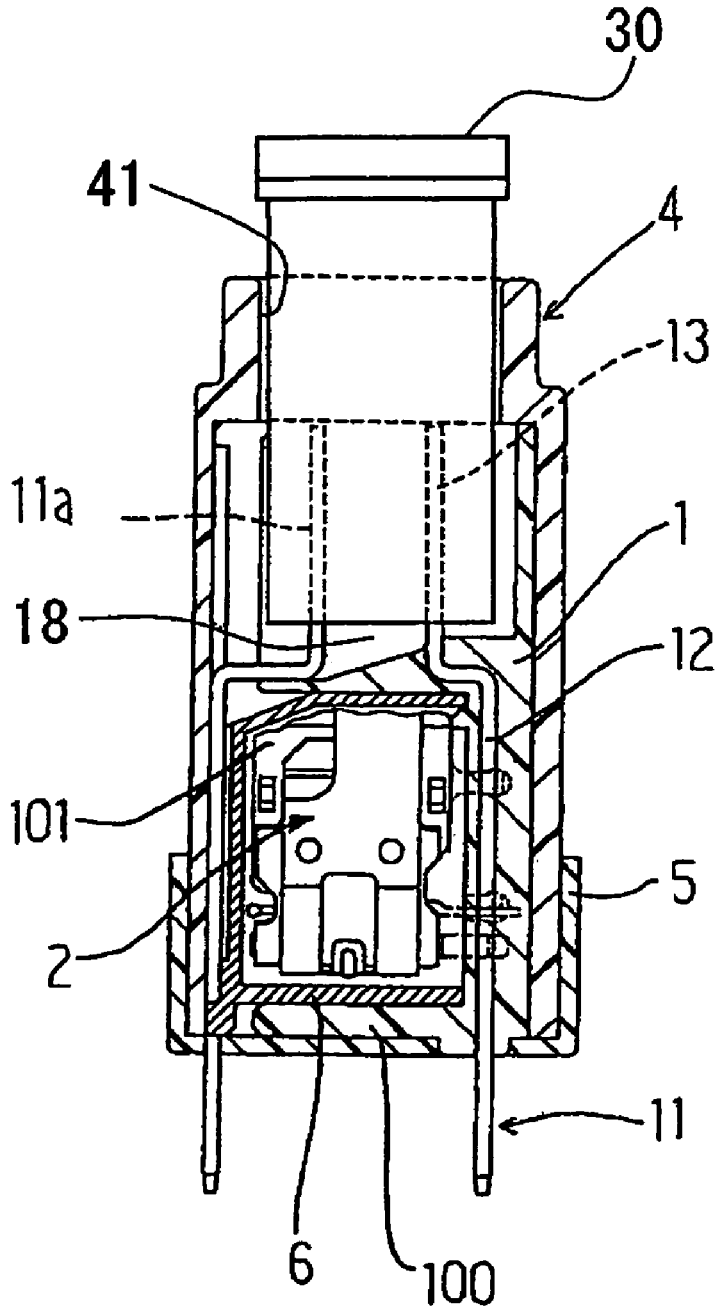
FIG. 2 is a cross-sectional view showing the relay device according to the FIG. 1 embodiment.

Referring to FIGS. 1 and 2, a complex relay device according to an exemplary embodiment of the present invention is illustrated.

A bus bar base plate 1 of the complex relay device has multiple bus bars 12 having end portions that provide terminals 11 for external connection. The multiple bus bars 12 are formed in predetermined circuit patterns respectively. The bus bars 12 are integrated and covered with a resin except for the ends thereof, which are exposed to outside. The bus bar base plate 1 is produced by providing a resin insertion forming process to a conductive plate that has undergone a press-punching process. The external connection terminal 11 protrudes downward from a lower side of the flat bus bar base plate 1 in FIG. 1 or 2 along a plane, along which the other part of the bas bar 12 covered by the resin extends. A fuse connection terminal 13 is provided by an end of the bus bar 12 extending upward from an upper side of the bus bar base plate 1 in FIG. 1 or 2. A fuse 30 is fitted to the fuse connection terminal 13. The fuse connection terminal 13 extends in parallel with the other portion of the bus bar 12 covered by the resin.

Relay units 2, 3 are fixed to a common flat main surface of the bus bar base plate 1 to be adjacent to each other side by side. The relay units 2, 3 are connected with the external connection terminals 11 through the bus bars 12.

A resin relay case 4 substantially hermetically accommodates the bus bar base plate 1 and the relay units 2, 3 mounted on the bus bar base plate 1.

Each one of the relay units 2, 3 has a coil bobbin 20, a coil 21, an L-shaped yoke 22, a movable iron piece 23, a plate spring 24, a movable contact 25, and fixed contacts 26, 27. The coil bobbin 20 includes a magnetic core (not shown). A side of the yoke 22 contacts a left end surface of the coil bobbin 20 in FIG. 1. An end of the magnetic core is fitted into a hole formed in the side of the yoke 22. The other side of the yoke 22 extends in parallel with an axial center of the coil bobbin 20 along the coil 21 to a proximity of the right end surface of the coil bobbin 20 in FIG. 1. The movable iron piece 23 extends from a proximity of a tip end of the other side of the yoke 22 substantially in parallel with the right end surface of the coil bobbin 20. An end of the spring 24 is fixed to the other side of the yoke 22, and the movable iron piece 23 is fixed to the other end of the spring 24. If the coil 21 is energized, a magnetic flux is formed through a magnetic circuit provided by the magnetic core, the yoke 22, and the movable iron piece 23, and the magnetic core attracts the movable iron piece 23. If the energization is stopped, the movable iron core 23 is moved to an original position by a resilient force of the spring 24. The movable contact 25 fixed to a tip end of the spring 24 intimately contacts either one of the fixed contacts 26, 27 in accordance with the movement of the movable iron piece 23. The fixed contact 26 is bonded to an end 14 that is formed by cutting and bending a part of the bus bar 12. The fixed contact 27 is bonded to an additional metal plate 15 that is bonded to the bus bar 12 and uncovered. The additional metal plate 15 is held by a resin wall 16 protruding from the bus bar base plate 1. By bonding the yoke 22 to an uncovered end of a fixing metal plate (not shown) fixed to the bus bar base plate 1, each one of the relay units 2, 3 is fixed to the bus bar base plate 1. The fixing metal plate is formed at the same time as the bus bars 12 through a pressing forming process of the bus bars 12.

The bus bar base plate 1 is a molded resin product having a sectional shape shown in FIG. 2. The bus bars 12 made of copper alloy are integrated with the bus bar base plate 1 through an insertion forming process. The bus bar base plate 1 is formed with a partition wall 100 extending from a side on which the relay units 2, 3 are mounted. The partition wall 100 defines a space 101 for accommodating the relay units 2, 3.

The external connection terminals 11 provide multiple terminals of contact circuits, which are connected with contacts 25–27 of the relay units 2, 3 through the bus bars 12. The terminals 11 also provide multiple terminals of coil circuits, which are connected to both ends of the coils 21 of the relay units 2, 3 through the bus bars 12.

A power source terminal 11 a is formed separately from the bus bar base plate 1. An upper end of the power source terminal 11 a faces the fuse connection terminal 13 across a predetermined clearance with respect to the thickness direction of the bus bar base plate 1. A fuse 30 is mounted between the upper end of the power source terminal 11*a* and the fuse connection terminal 13. Accordingly, the fuse is connected with the spring 24 and the movable contact 25 serially. Thus, a contact circuit leading from the power source terminal 11*a* to the contact circuit terminal provided by the external connection terminal 11 through the fuse, the movable contact 25, and the fixed contacts 26, 27, is formed. The terminals of the coil circuits provided by the external connection terminals 11 are respectively connected with exposed ends (not shown) of the bus bars 12. The exposed ends are bonded to coil stoppers of the relay units 2, 3. Both ends of the coils 21 are respectively connected to the coil stoppers.

The relay case 4 is provided by a resin rectangular box having an upper surface and a downward opening. Fuse mounting holes 41, 42 are formed in the upper surface of the relay case 4 as shown in FIG. 1. The bus bar base plate 1 is formed with concave portions 18, 19 respectively communicating with the holes 41, 42. The concave portions 18, 19 are defined and formed by a partition wall protruding from the bus bar base plate 1. The upper end of the power source terminal 11*a* and the fuse connection terminal 13 protrude upward respectively through each one of the concave portions 18, 19.

A rectangular-box-shaped lid 5 is formed with an upward opening as shown in FIG. 1 or 2. The lid 5 is fitted to the lower portion of the relay case 4 to cover the downward opening of the relay case 4. The lower end of the power source terminal 11*a* and the external connection terminals 11 protrude downward through the lid 5 as shown in FIG. 1 or 2.

A shield plate 6, which should be preferably made of a resin, substantially hermetically encloses the bus bar base plate 1 and the relay units 2, 3.

Figure 3A:
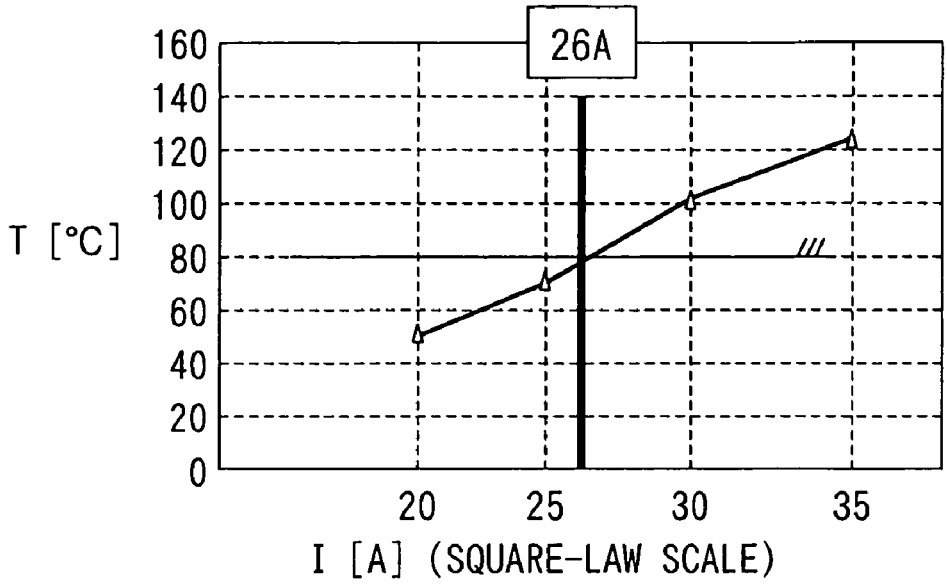
FIG. 3A is a graph showing a relationship between temperature increase at a spring and a contact current of a double relay device according to the FIG. 1 embodiment.

FIG. 3A is a graph showing a relationship between temperature increase at a spring and a contact current of a double relay device according to the FIG. 1 embodiment.

Figure 3B:
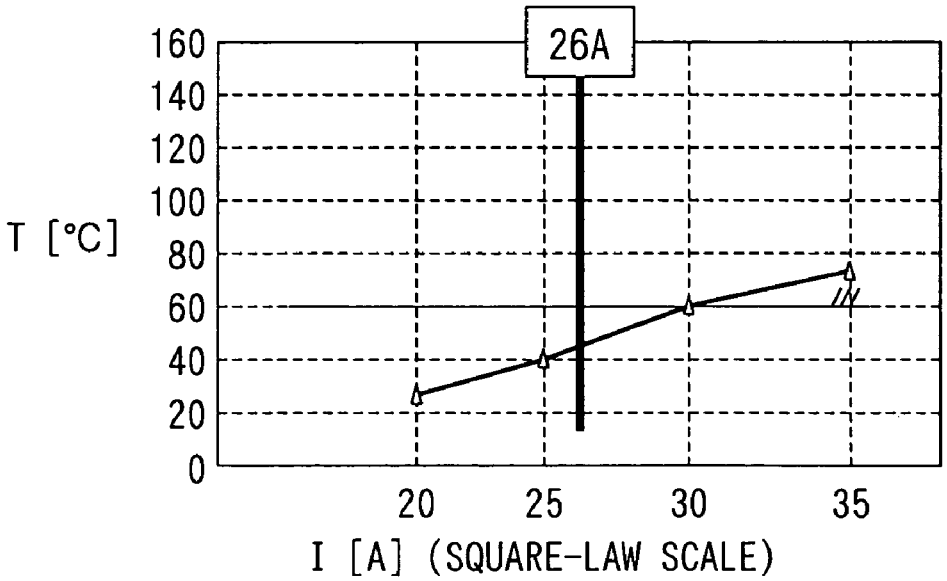
FIG. 3B is a graph showing a relationship between temperature increase at an external connection terminal and the contact current of the double relay device according to the FIG. 1 embodiment.
Figure 4A:
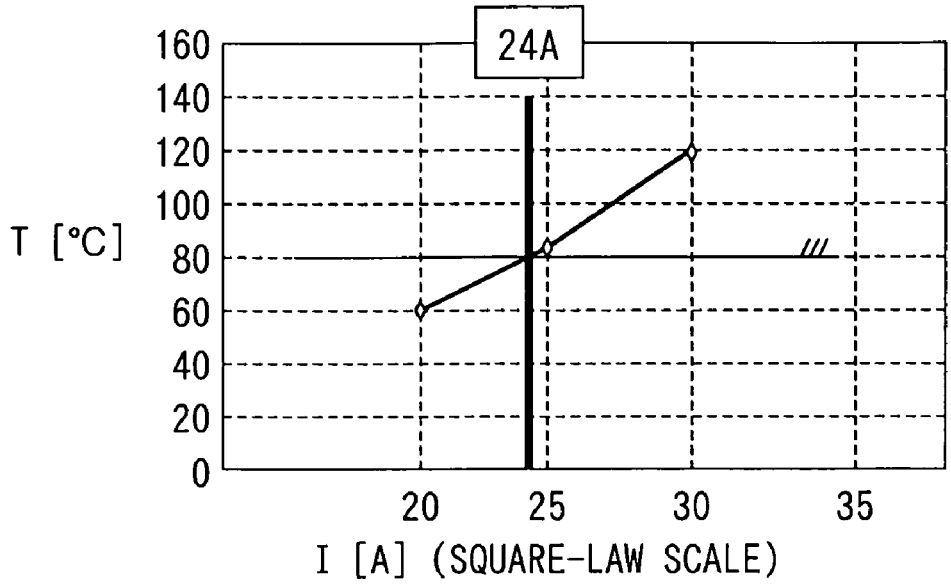
FIG. 4A is a graph showing a relationship between temperature increase at a spring and a contact current of a triple relay device of a comparative example.
Figure 4B:
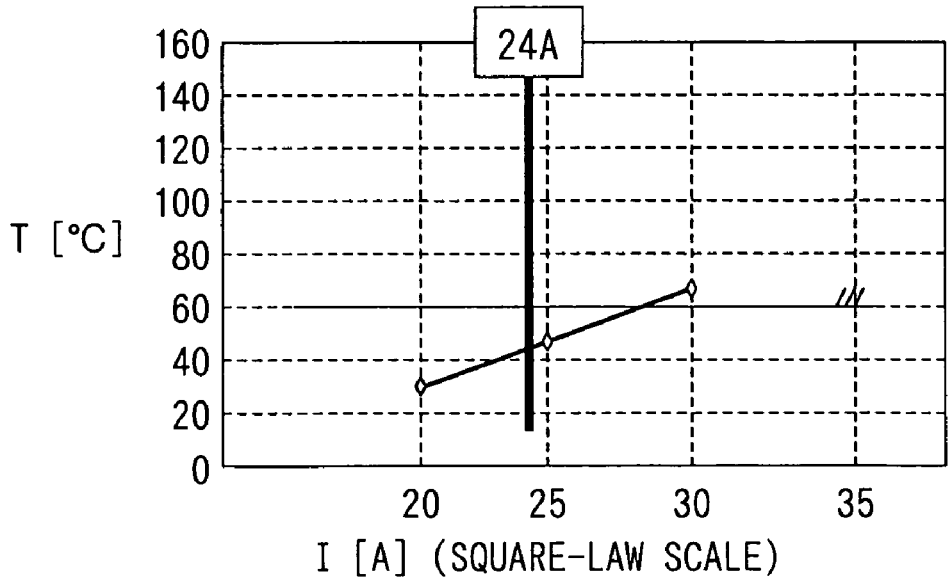
FIG. 4B is a graph showing a relationship between temperature increase at an external connection terminal and the contact current of the triple relay device of the comparative example.

A relationship between temperature increase at the spring 24 and a contact current (current flowing through the contact) of the double relay device according to this example embodiment is shown in FIG. 3A. A relationship between temperature increase at the external connection terminal 11 as the terminal of the contact circuit and the contact current of the double relay device according to this example embodiment is shown in FIG. 3B. A relationship between temperature increase at a spring and a contact current of a triple relay device of a comparative example is shown in FIG. 4A. A relationship between temperature increase at an external connection terminal as a terminal of a contact circuit and the contact current of the triple relay device of the comparative example is shown in FIG. 4B. Width of the triple relay device is set substantially half as large again as the double relay device to accommodate an additional relay unit. The three relay units are arranged serially. It is assumed that ambient temperature is 80° C., and a coil voltage and a power source voltage applied to the contact circuit are 14V. The contact current is adjusted by regulating a resistance of a load to which the contact circuit provides the electricity. In FIG. 4A, the temperature increase is that of the spring of a central relay unit sandwiched between the two other relay units. In FIG. 4B, the temperature increase is of the external connection terminal of the central relay unit sandwiched between the other two relay units. When the maximum contact temperature increase is set at 80° C., the contact current of the double relay device is 26A as shown in FIGS. 3A and 3B, and the contact current of the triple relay device is 24A as shown in FIGS. 4A and 4B. In the case where the body size of each relay unit of the double relay device is the same as that of the triple relay device, the maximum contact current of the double relay device can be set larger that that of the triple relay device by 2A. Therefore, if the maximum contact current of the double relay device is made equal to that of the triple relay device, the electric resistance of the contact circuit or the coil circuit of the double relay device can be increased compared to the triple relay device. Accordingly, the double relay device can be reduced in size and weight correspondingly.

Figure 5:
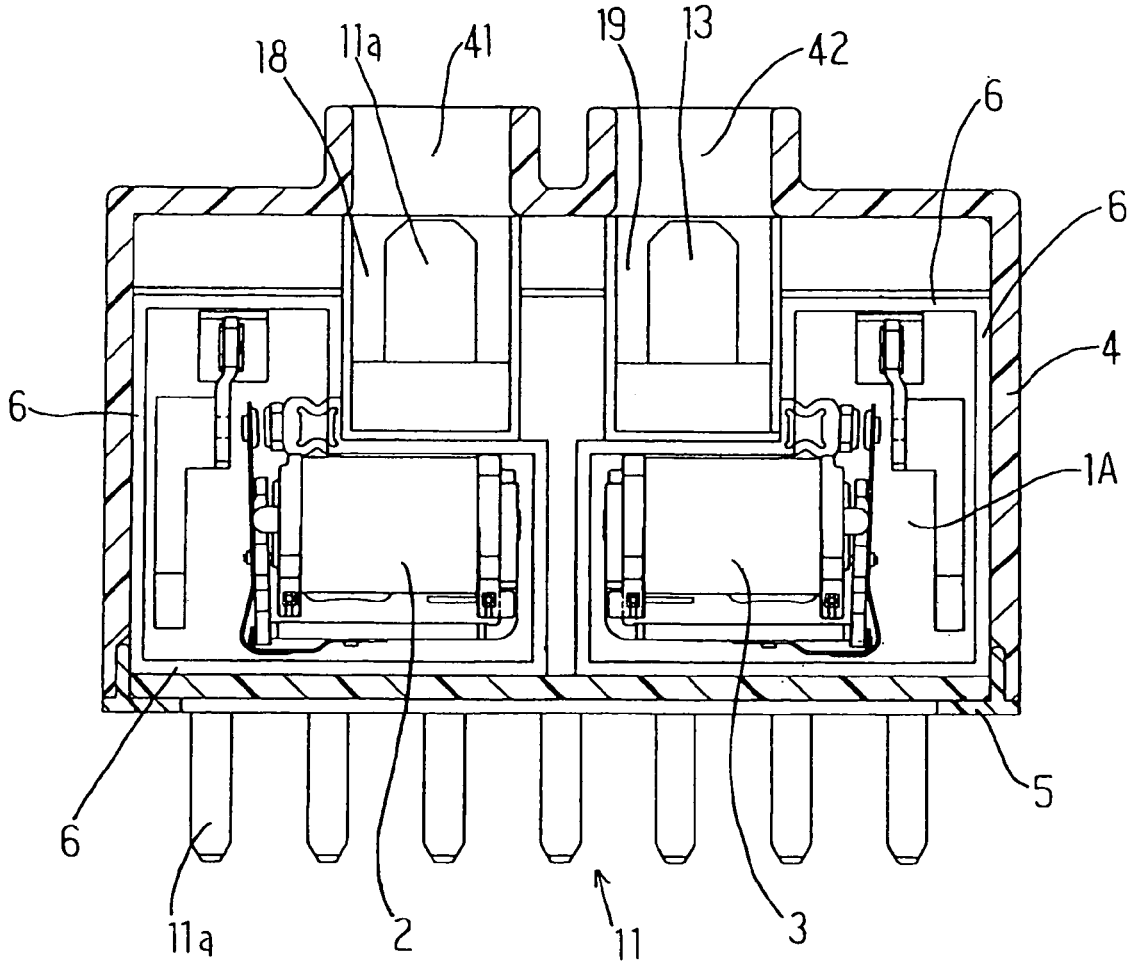
FIG. 5 is a longitudinal cross-sectional view showing a relay device according to another exemplary embodiment of the present invention.
Figure 6:
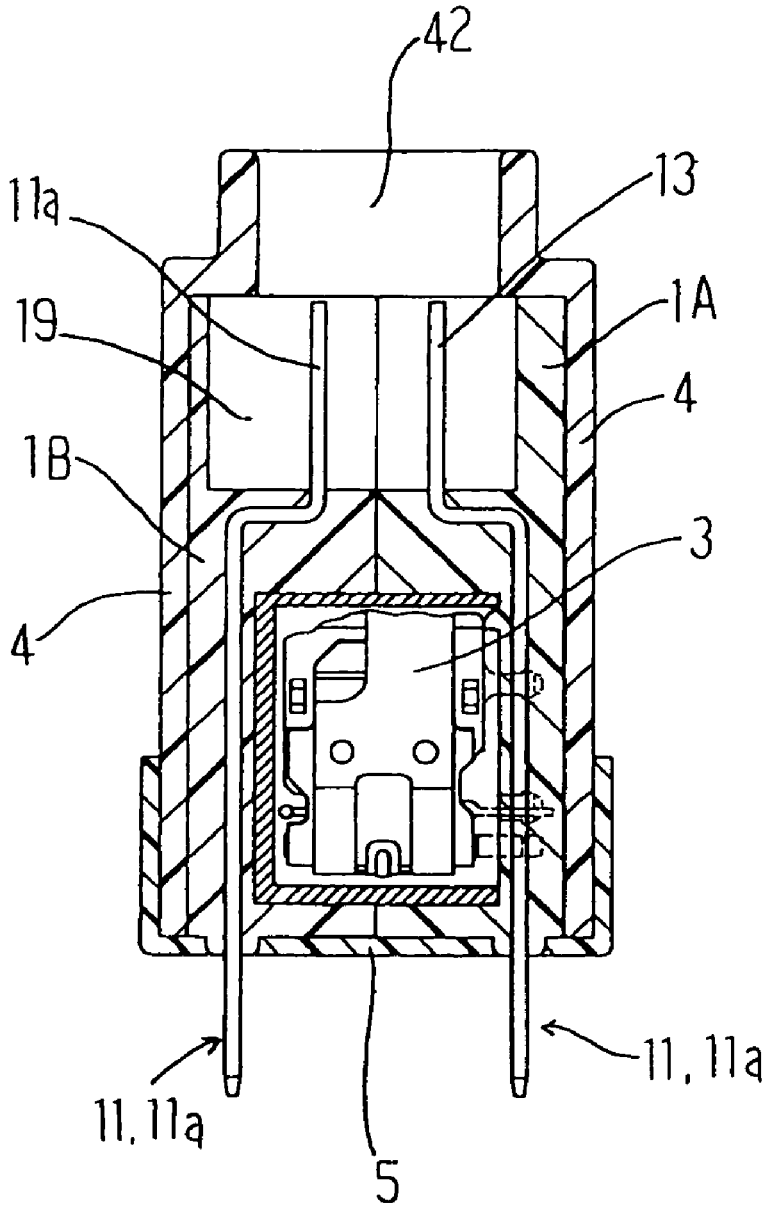
FIG. 6 is a cross-sectional view showing the relay device according to the FIG. 5 embodiment.
Figure 7:
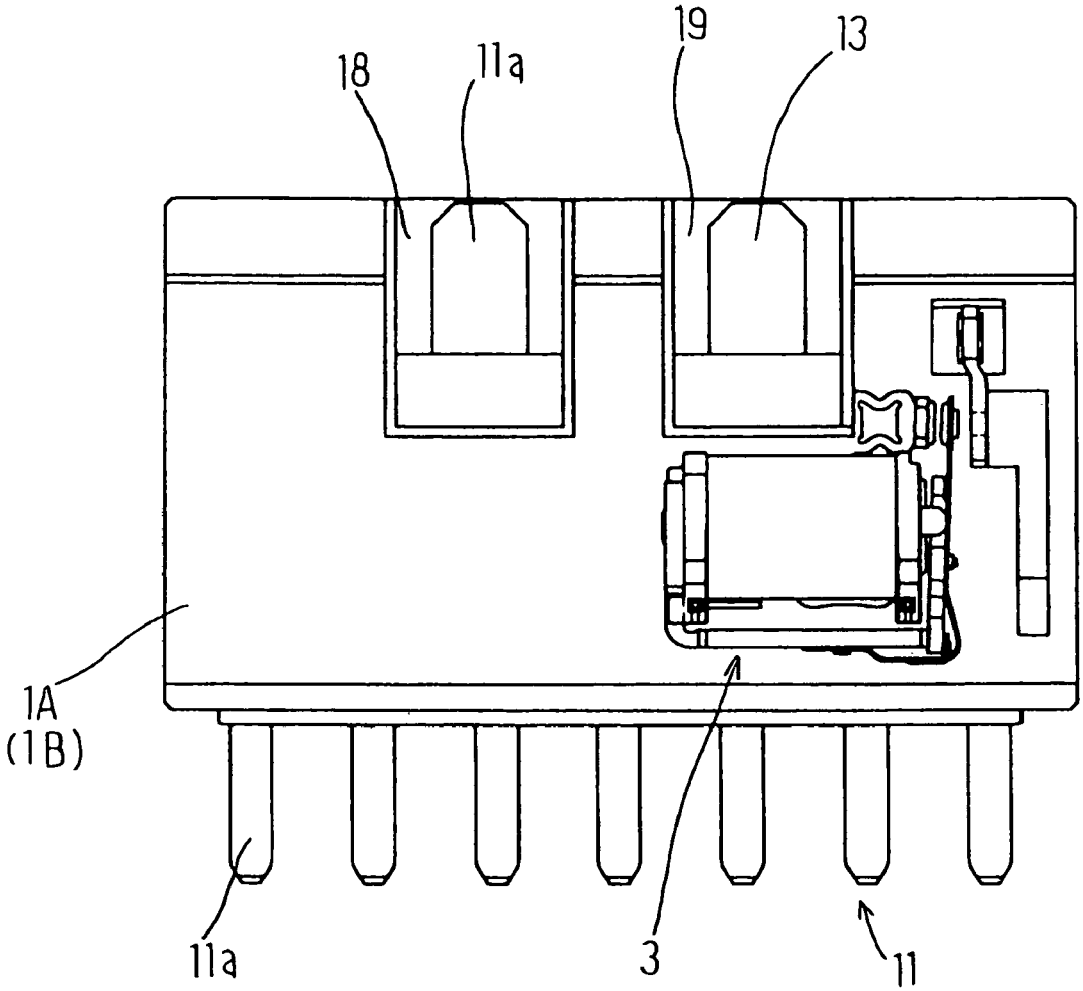
FIG. 7 is a front view of a subassembly according to the FIG. 5 embodiment.

A complex relay device according to another exemplary embodiment is shown in FIGS. 5 to 7.

The complex relay device of this exemplary embodiment has a bus bar base plate 1A, to which a relay unit 2 is mounted, and a bus bar base plate 1B, to which a relay unit 3 is mounted. The two bus bar base plates 1A, 1B are arranged in parallel with each other to sandwich the two relay units 2, 3. The bus bar base plates 1A, 1B are formed in the same shape. One of the two bus bar base plates 1A, 1B is shown in FIG. 7. As shown in FIG. 6, a concave relay unit accommodation space formed on the bus bar base plate 1A and a concave relay unit accommodation space formed on the bus bar base plate 1B are combined with each other to define a combined space. The combined space has openings on both lateral sides thereof. The relay units 2, 3 are accommodated in the combined space. The bus bar base plates 1A, 1B and two shield metal plates 6 substantially hermetically enclose the relay units 2, 3. The two shield metal plates 6 surround the relay units 2, 3 respectively. Each one of the bus bar base plates 1A, 1B of this exemplary embodiment has aligned power source terminals 11*a* and external connection terminals as shown in FIGS. 5–7.

The relay case 4 is provided by a resin rectangular box having an upper surface and a downward opening. Fuse mounting holes 41, 42 are formed in the upper surface. Each one of the bus bar base plates 1A, 1B is formed with concave portions 18, 19 respectively communicating with the holes 41, 42. The concave portions 18, 19 are respectively defined by partition walls protruding from the bus bar base plates 1A, 1B. An upper end of the power source terminal 11*a* protruding upward from the bus bar base plate 1B and a fuse mounting terminal 13 protruding upward from the bus bar base plate 1A protrude upward into the concave portion 18. An upper end of the power source terminal 11*a* protruding upward from the bus bar base plate 1A and a fuse mounting terminal 13 protruding upward from the bus bar base plate 1B protrude upward into the concave portion 19.

As shown in FIG. 7, the relay unit is mounted on a main surface of the bus bar base plate so that the relay unit is deviated toward the right side or the left side. A pair of subassemblies, each one of which is provided by the bus bar base plate and the relay unit, are located to face each other and are accommodated in the relay case 4. Thus, the double relay device is provided.

By using this structure, subassemblies having different functions or current capacities can be combined as required. For example, an optimum pair of relays can be integrated in a compact size in accordance with uses. In the case where the relay units 2, 3 are the same type, two assemblies having the common relay units and bus bar base plates are used. As a result, an increase of the number of parts can be inhibited.

It is possible to practice the invention by providing a complex relay device having more than two relay units, as long as the relay device does not include any relay unit that is sandwiched between two relay units. For example, the complex relay device could have four relay units arranged in a two-by-two matrix. According to another example, the complex relay device could have eight relay units arranged in a three-dimensional, two-by-two-by-two matrix. In either case, the relay device does not include any relay unit that is sandwiched between two relay units.

The present invention should not be limited to the exemplary embodiments, but may be implemented in many other ways without departing from the spirit of the invention.

What is claimed is:

1. A complex relay device comprising:

two bus bar base plates having a plurality of bus bars that have ends providing terminals and are formed in predetermined circuit patterns, the bus bars being integrated and covered with a resin except for at least the ends of the bus bars;

only two relay units fixed and connected to the two bus bar base plates, respectively, such that the two relay units are adjacent to each other and are connected to the terminals, which are used for external connection, through the bus bars;

the two bus bar base plates are located in parallel with each other across the two relay units; and a relay case that accommodates at least the two bus bar base plates and the two relay units.

2. The complex relay device as in claim 1, wherein the two relay units are located at the same positions of the two bus bar base plates, which have the same shape.

3. The complex relay device as in claim 1, wherein the ends of the bus bars providing the terminals for external connection protrude from a side of the two bus bar base plates, a profile of which is substantially flat, and extend along a plane, along which the portions of the bus bars covered with the resin extend.

4. The complex relay device as in claim 3, wherein the bus bars have another end that protrudes from the other side of the two bus bar base plates parallel to the side of the two bus bar base plates from which the terminal for external connection protrudes, and that provides a fuse connection terminal, to which a fuse is mounted.

5. A complex relay device comprising:

two bus bar base plates having a plurality of bus bars that have ends providing terminals and are formed in predetermined circuit patterns, the bus bars being integrated and covered with a resin except for at least the ends of the bus bars;

a first relay unit and a second relay unit, the first and second relay units fixed and connected to the two bus bar base plates, respectively, such that the first and second relay units are adjacent to each other and are connected to the terminals, which are used for external connection, through the bus bars;

the two bus bar base plates are located in parallel with each other across the first and second relay units; and a relay case that accommodates at least the two bus bar base plates and the first and second relay units, wherein the relay device does not include any relay unit that is sandwiched between two relay units.

6. The complex relay device as in claim 5, wherein the first and second relay units are located at the same positions of the two bus bar base plates, which have the same shape.

7. The complex relay device as in claim 5, wherein the ends of the bus bars providing the terminals for external connection protrude from a side of the two bus bar base plates, a profile of which is substantially flat, and extend along a plane, along which the portions of the bus bars covered with the resin extend.

8. The complex relay device as in claim 7, wherein the bus bars have another end that protrudes from the other side of the two bus bar base plates parallel to the side of the two bus bar base; plates from which the terminal for external connection protrudes, and that provides a fuse connection terminal, to which a fuse is mounted.

9. A complex relay device comprising:

two bus bar base plates having a plurality of bus bars that have ends providing terminals and are formed in predetermined circuit patterns, the bus bars being integrated and covered with a resin except for at least the ends of the bus bars;

at least two relay units, the at least two relay units fixed and connected to the two bus bar base plates, respectively, such that the at least two relay units are adjacent to each other and are connected to the terminals, which are used for external connection, through the bus bars;

the two bus bar base plates are located in parallel with each other across the at least two relay units; and a relay case that accommodates at least the two bus bar base plates and the at least two relay units, wherein the relay device does not include any relay unit that is sandwiched between two relay units.

10. The complex relay device as in claim 9, wherein the at least two relay units are located at the same positions of the two bus bar base plates, which have the same shape.

11. The complex relay device as in claim 9, wherein the ends of the bus bars providing the terminals for external connection protrude from a side of the two bus bar base plates, a profile of which is substantially flat, and extend along a plane, along which the portions of the bus bars covered with the resin extend.

12. The complex relay device as in claim 11, wherein the bus bars have another end that protrudes from the other side of the two bus bar base plates parallel to the side of the two bus bar base plates from which the terminal for external connection protrudes, and that provides a fuse connection terminal, to which a fuse is mounted.

* * * * *